US010884350B2

(12) United States Patent
Takebayashi et al.

(10) Patent No.: US 10,884,350 B2
(45) Date of Patent: Jan. 5, 2021

(54) TONER, TONER ACCOMMODATING UNIT, AND IMAGE FORMING APPARATUS

(71) Applicants: Toma Takebayashi, Shizuoka (JP); Taichi Nemoto, Shizuoka (JP)

(72) Inventors: Toma Takebayashi, Shizuoka (JP); Taichi Nemoto, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/452,789

(22) Filed: Jun. 26, 2019

(65) Prior Publication Data

US 2020/0012206 A1 Jan. 9, 2020

(30) Foreign Application Priority Data

Jul. 6, 2018 (JP) ..... 2018-129285
Jun. 3, 2019 (JP) ..... 2019-103578

(51) Int. Cl.
*G03G 9/087* (2006.01)
*G03G 15/08* (2006.01)
*G03G 9/08* (2006.01)

(52) U.S. Cl.
CPC ..... *G03G 9/08755* (2013.01); *G03G 9/0825* (2013.01); *G03G 9/08711* (2013.01); *G03G 9/08797* (2013.01); *G03G 15/0865* (2013.01)

(58) Field of Classification Search
CPC ..... G03G 9/08755; G03G 9/0825; G03G 9/08711; G03G 9/0821; G03G 9/08797
See application file for complete search history.

(56) References Cited

U.S. PATENT DOCUMENTS 5,955,234 A * 9/1999 Matsunaga ..... C08F 257/00 430/109.3
6,740,462 B2 * 5/2004 Bartscher ..... G03G 9/0821 399/336
7,001,701 B2 * 2/2006 Fujii ..... G03G 5/0517 430/108.4
8,084,178 B2 * 12/2011 Tosaka ..... G03G 9/0806 430/108.4
8,741,529 B2 * 6/2014 Aoki ..... G03G 15/0189 430/109.4
2014/0255840 A1 * 9/2014 Sekiguchi ..... G03G 9/08755 430/105
2015/0132690 A1 5/2015 Asahina et al.
2017/0242358 A1 * 8/2017 Kawamura ..... G03G 9/08797
2017/0336726 A1 * 11/2017 Hasegawa ..... G03G 9/0821
2018/0267417 A1 9/2018 Mizoguchi et al.

FOREIGN PATENT DOCUMENTS

JP 2005-015589 1/2005
JP 2012-063559 3/2012
JP 2015-092212 5/2015
JP 2017-211647 11/2017

OTHER PUBLICATIONS

U.S. Appl. No. 16/238,566, filed Jan. 3, 2019, Taichi Nemoto, et al.
U.S. Appl. No. 16/259,006, filed Jan. 28, 2019, Minoru Masuda, et al.
K. Kjoller, et al., "Fractured polymer / silica fiber surface studied by tapping mode atomic force microscopy", Surface Science Letters 290 (1993) L688-L692.
R. van den Berg, et al., "Atomic force microscopy of thin triblock copolymer films", Polymer vol. 35 No. 26 1994, p. 5778-5781.
M. A. van Dijk, et al., "Ordering Phenomena in Thin Block Copolymer Films Studied Using Atomic Force Microscopy", Macromolecules 1995, 28, 6773-6778.

* cited by examiner

*Primary Examiner* — Christopher D Rodee
(74) *Attorney, Agent, or Firm* — Oblon, McClelland, Maier & Neustadt, L.L.P.

(57) ABSTRACT

A toner is provided. The toner comprises a binder resin, a colorant, and a release agent. The binder resin comprises a polyester resin comprising a crystalline polyester resin. The crystalline polyester resin forms domains having a number average long diameter of from 0 to 50 nm in a cross-section of the toner. The toner satisfies the following relation:

$$G'(50)/G'(90) \geq 6.0 \times 10^2$$

where G'(50) and G'(90) represent storage elastic modulus of the toner at 50 degrees C. and 90 degrees C., respectively.

17 Claims, 1 Drawing Sheet

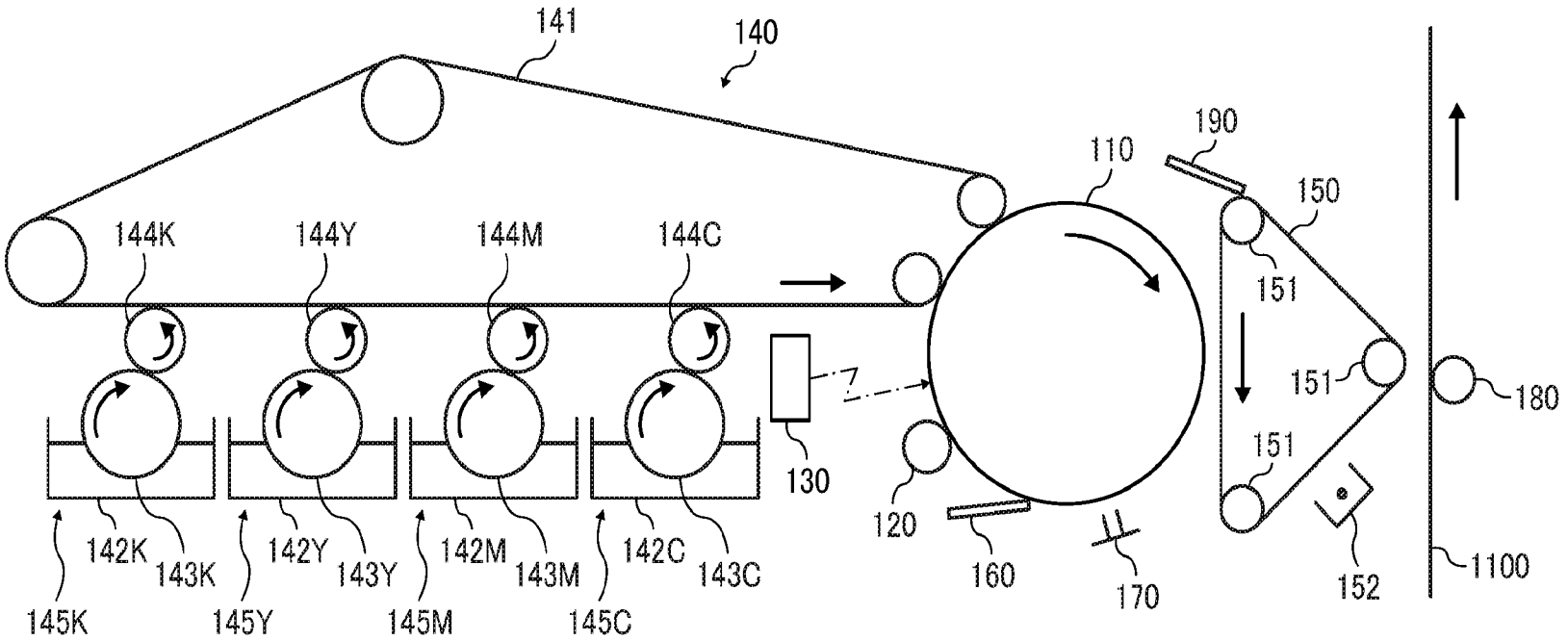
180
1100
152
150
151
151
151
190
110
170
160
120
130
140
141
144C
143C
142C
145C
144M
143M
142M
145M
144Y
143Y
142Y
145Y
144K
143K
142K
145K

TONER, TONER ACCOMMODATING UNIT, AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2018-129285 and 2019-103578, filed on Jul. 6, 2018 and Jun. 3, 2019, respectively, in the Japan Patent Office, the entire disclosure of each which is hereby incorporated by reference herein.

BACKGROUND

Technical Field

The present disclosure relates to a toner, a toner accommodating unit, and an image forming apparatus.

Description of the Related Art

In recent years, it has been required in the market to improve low-temperature fixability of toner for energy saving. In attempting to achieve low-temperature fixability of toner, a large number of toners have been proposed in which a crystalline resin and an amorphous resin are used in combination as binder resins.

However, if the crystalline resin is exposed at the surface of toner, the toner particles may aggregate due to stress received when being stirred in a developing device, resulting in an abnormal image and poor reliability of the toner. In attempting to solve this problem, technologies for dispersing the crystalline resin have been actively developed.

SUMMARY

In accordance with some embodiments of the present invention, a toner is provided. The toner comprises a binder resin, a colorant, and a release agent. The binder resin comprises a polyester resin comprising a crystalline polyester resin. The crystalline polyester resin forms domains having a number average long diameter of from 0 to 50 nm in a cross-section of the toner. The toner satisfies the following relation:

$$G'(50)/G'(90) \geq 6.0\times10^2$$

where G'(50) and G'(90) represent storage elastic modulus of the toner at 50 degrees C. and 90 degrees C., respectively.

In accordance with some embodiments of the present invention, a toner accommodating unit is provided. The toner accommodating unit includes a container and the above-described toner contained in the container.

In accordance with some embodiments of the present invention, an image forming apparatus is provided. The image forming apparatus includes: an electrostatic latent image bearer; an electrostatic latent image forming device configured to form an electrostatic latent image on the electrostatic latent image bearer; and a developing device containing the above-described toner, configured to develop the electrostatic latent image formed on the electrostatic latent image bearer with the toner to form a toner image.

BRIEF DESCRIPTION OF THE DRAWING

A more complete appreciation of the disclosure and many of the attendant advantages thereof will be readily obtained as the same becomes better understood by reference to the following detailed description when considered in connection with the accompanying drawing, which is intended to depict example embodiments of the present invention and should not be interpreted to limit the scope thereof. The accompanying drawing is not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

As the crystalline resin is finely dispersed in toner, the toner can be improved in both low-temperature fixability and heat-resistant storage stability. However, conventional proposals are insufficient for fine dispersion of the crystalline resin. Finely-dispersing techniques are further demanded so that the toner can achieve both low-temperature fixability and heat-resistant storage stability at high levels.

An embodiment of the present invention provides a toner that achieves both low-temperature fixability and heat-resistant storage stability.

Toner

The toner according to an embodiment of the present invention contains a binder resin, a colorant, and a release agent. Preferably, the toner further contains a styrene acrylic resin. The toner may further contain other components, as necessary.

The binder resin comprises a crystalline polyester resin.

The toner satisfies the following conditions (a) and (b). (a) In a cross-section of the toner, the crystalline polyester resin forms domains having a number average long diameter of from 0 to 50 nm. (b) The toner satisfies the following relation: $G'(50)/G'(90) \geq 6.0\times10^2$, where G'(50) and G'(90) represent storage elastic modulus of the toner at 50 degrees C. and 90 degrees C., respectively.

To achieve the above-described conditions, the binder resin is an appropriate combination of the crystalline polyester resin with a resin other than crystalline polyester resin. In general, compatibility between two or more different resins is discussed by solubility parameter ("SP"). It is desirable that the difference in SP between the crystalline polyester resin and the resin other than crystalline polyester resin in the binder resin is set within an appropriate range. As an example, when the difference in SP between an amorphous resin and the crystalline polyester resin is too small, the crystalline polyester resin becomes compatible with the amorphous resin to degrade heat-resistant storage stability and mechanical strength. By contrast, when the difference in SP is too large, the crystalline polyester resin and the amorphous resin become less compatible and it becomes more difficult to finely disperse them each other. Moreover, the crystalline polyester resin may be unevenly distributed on the surface of the resulting toner, causing deterioration of heat-resistant storage stability and mechanical strength.

On the other hand, it may also be true that compatibility between resins cannot be argued only by SP. The structure and composition of the resins should be appropriately designed based on a general fact that, for example, aromatics generally have high compatibility with aromatics and aliphatics generally have high compatibility with aliphatics.

The inventors of the present invention have found that a toner that provides high quality image can be obtained by designing the composition and physical properties of the toner as described above. Such a toner has the following properties.

- Sharply-melting property that can achieve both low-temperature fixability and heat-resistant storage stability of the toner at high levels.
- Reducing undesirable phenomena unique to toners containing a crystalline resin, such as cohesion of toner particles in a developing device due to lack of mechanical durability, carrier contamination, in-machine contamination, and deterioration of chargeability and fluidity due to embedment of external additives.

Binder Resin

The binder resin contains a crystalline polyester resin, preferably contains a styrene acrylic resin, and may further contain other components, as necessary.

Crystalline Polyester Resin

A crystalline polyester resin ("crystalline polyester") is contained to achieve both low-temperature fixability and heat-resistant storage stability.

Monomers used to prepare the crystalline polyester is not particularly limited and can be appropriately selected according to the purpose. Examples thereof include, but are not limited to, diol components and dicarboxylic acid components to be described in detail later.

The melting point of the crystalline polyester resin is preferably from 60 to 120 degrees C. for low-temperature fixability.

It is preferable that the amount of residual monomer oligomers remaining in the crystalline polyester be as small as possible.

The weight average molecular weight of the crystalline polyester is preferably 10,000 or higher. The upper limit of the weight average molecular weight is not limited, but the weight average molecular weight is preferably 35,000 or lower for the ease of production.

The method of introducing the crystalline polyester resin into the toner is not particularly limited and can be appropriately selected according to the purpose. For example, the crystalline polyester resin may be mechanically crushed by a bead mill and dispersed in a liquid dispersion and then introduced into the toner, or kneaded with a binder resin to be a master batch and then introduced to the toner.

Styrene Acrylic Resin

The styrene acrylic resin is preferably contained in the toner to make the toner negatively chargeable.

Preferably, the styrene acrylic resin is a polymer synthesized from a vinyl polymerizable monomer. The vinyl polymerizable monomer may be either a monofunctional polymerizable monomer or a polyfunctional polymerizable monomer.

Examples of the monofunctional polymerizable monomer include, but are not limited to: styrene derivatives such as styrene, α-methylstyrene, β-methylstyrene, o-methylstyrene, m-methyl styrene, p-methyl styrene, 2,4-dimethyl styrene, p-n-butylstyrene, p-tert-butyl styrene, p-n-hexylstyrene, p-n-octylstyrene, p-n-nonylstyrene, p-n-decylstyrene, p-n-dodecyl styrene, p-methoxystyrene, and p-phenylstyrene; acrylic polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate: methacrylic polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; vinyl esters such as methylene aliphatic monocarboxylic acid esters, vinyl acetate, vinyl propionate, vinyl butyrate, vinyl benzoate, and vinyl formate; vinyl ethers such as vinyl methyl ether, vinyl ethyl ether, and vinyl isobutyl ether; and vinyl ketones such as vinyl methyl ketone, vinyl hexyl ketone, and vinyl isopropyl ketone. Each of these materials can be used alone or in combination with others.

Examples of the polyfunctional polymerizable monomer include, but are not limited to, diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinyl naphthalene, and divinyl ether. Each of these materials can be used alone or in combination with others.

The proportion of the styrene acrylic resin in the binder resin is preferably less than 10% by mass, more preferably 5% by mass or less. When the proportion of the styrene acrylic resin is less than 10% by mass, it is advantageous in terms of low-temperature fixability.

Other Components

The binder resin may further contain any known resin other than the crystalline polyester and the styrene acrylic resin. In particular, an amorphous polyester resin ("amorphous polyester") is preferably used to make the toner exhibit more excellent low-temperature fixability. More preferably, two or more amorphous polyester resins are used in combination. The composition of the polyester resin (including both the amorphous polyester resin and the crystalline polyester resin) can be changed as appropriate, for example, to impart compatibility with colorants and release agents such as wax (to be described later) or to use diol components and/or dicarboxylic acid components as monomers.

Diol Components

Specific examples of the diol components include, but are not limited to: aliphatic diols such as ethylene glycol, 1,2-propylene glycol, 1,3-propylene glycol, 1,4-butanediol, 2-methyl-1,3-propanediol, 1,5-pentanediol, 3-methyl-1,5-pentanediol, 1,6-hexanediol, 1,8-octanediol, 1,10-decanediol, and 1,12-dodecanediol; oxyalkylene-group-containing diols such as diethylene glycol, triethylene glycol, dipropylene glycol, polyethylene glycol, polypropylene glycol, and polytetramethylene glycol; alicyclic diols such as 1,4-cyclohexanedimethanol and hydrogenated bisphenol A; alkylene oxide (e.g., ethylene oxide, propylene oxide, and butylene oxide) adducts of alicyclic diols; bisphenols such as bisphenol A, bisphenol F, and bisphenol S; and alkylene oxide (e.g., ethylene oxide, propylene oxide, and butylene oxide) adducts of bisphenols. Among these, aliphatic diols having 4 to 12 carbon atoms are preferable.

Each of these diols can be used alone or in combination with others.

Dicarboxylic Acid Components

Examples of the dicarboxylic acid components include, but are not limited to, aliphatic dicarboxylic acids and aromatic dicarboxylic acids. In addition, anhydrides, lower alkyl (C1-C3) esters, and halides thereof may also be used.

Specific examples of the aliphatic dicarboxylic acids include, but are not limited to, succinic acid, adipic acid, sebacic acid, dodecanedioic acid, maleic acid, and fumaric acid.

Specific preferred examples of the aromatic dicarboxylic acids include, but are not limited to, those having 8 to 20 carbon atoms.

Specific examples of the aromatic dicarboxylic acids having 8 to 20 carbon atoms include, but are not limited to, phthalic acid, isophthalic acid, terephthalic acid, and naphthalene dicarboxylic acids.

Among these, aliphatic dicarboxylic acids having 4 to 12 carbon atoms are preferable.

Each of these dicarboxylic acids can be used alone or in combination with others.

For the purpose of controlling melting characteristics, a branching component and/or a cross-linking component may be contained as monomer components.

Examples of the branching component and the cross-linking component include, but are not limited to, polyfunctional aliphatic alcohols such as trimethylolpropane and pentaerythritol, polyfunctional carboxylic acids such as trimellitic acid, and isocyanurate comprising a trimer of hexamethylene diisocyanate.

Preferably, the proportion of the polyester resin in the binder resin is 90% by mass or more. Preferably, the upper limit of the proportion of the polyester resin is 100% by mass. Here, the polyester resin includes both the crystalline polyester and the amorphous polyester. Therefore, in the toner containing both the crystalline polyester and the amorphous polyester, the proportion of the polyester resin refers to the total proportion of the crystalline polyester and the amorphous polyester.

When the proportion of the polyester resin is 90% by mass or more, low-temperature fixability is improved.

The proportion of the binder resin in the toner is not particularly limited and can be appropriately selected according to the purpose. For example, the proportion of the binder resin in a mother toner particle that comprises the binder resin, a colorant, and a release agent may be from 10% to 95% by mass. When the proportion is in the above range, low-temperature fixability and charging property are excellent.

Colorant

Examples of the colorant include, but are not limited to, pigments and dyes such as carbon black, lamp black, iron black, aniline blue, phthalocyanine blue, phthalocyanine green, Hansa Yellow G, Rhodamine 6C Lake, Calco Oil Blue, chrome yellow, quinacridone, benzidine yellow, rose bengal, and triarylmethane dyes. Each of these colorants can be used alone or in combination with others. The toner may be used for either single-color image formation and full-color image formation.

The proportion of the colorant to the binder resin in the toner is preferably from 1% to 30% by mass, more preferably from 3% to 20% by mass.

Release Agent

The release agent is not particularly limited and may be appropriately selected depending on the purpose. Specific examples of the release agent include, but are not limited to, carbonyl-group-containing waxes, polyolefin waxes, and long-chain hydrocarbon waxes. Each of these materials can be used alone or in combination with others. Among these, carbonyl-group-containing waxes are preferable.

Specific examples of the carbonyl-group-containing waxes include, but are not limited to, polyalkanoic acid ester, polyalkanol ester, polyalkanoic acid amide, polyalkyl amide, and dialkyl ketone.

Specific examples of the polyalkanoic acid ester include, but are not limited to, carnauba wax, montan wax, trimethylolpropane tribehenate, pentaerythritol tetrabehenate, pentaerythritol diacetate dibehenate, glycerin tribehenate, and 1,18-octadecanediol distearate.

Specific examples of the polyalkanol ester include, but are not limited to, tristearyl trimellitate and distearyl maleate.

Specific examples of the polyalkanoic acid amide include, but are not limited to, dibehenylamide.

Specific examples of the polyalkyl amide include, but are not limited to, trimellitic acid tristearylamide.

Specific examples of the dialkyl ketone include, but are not limited to, distearyl ketone.

Among these carbonyl-group-containing waxes, polyalkanoic acid ester is preferable.

Specific examples of the polyolefin waxes include, but are not limited to, polyethylene wax and propylene wax. Specific examples of the long-chain hydrocarbon waxes include, but are not limited to, paraffin wax and SASOL wax.

The melting point of the release agent is not particularly limited and may be appropriately selected according to the purpose, but is preferably from 50 to 100 degrees C., and more preferably from 60 to 90 degrees C. When the melting point is from 50 to 100 degrees C., the following undesired phenomena can be prevented.

Heat-resistant storage stability is adversely affected.

Cold offset is caused in low-temperature fixing.

The melting point of the release agent can be measured with a differential scanning calorimeter (TA-60WS and DSC-60 available from Shimadzu Corporation) as follows.

First, about 5.0 mg of the release agent is put in a sample container made of aluminum. The sample container is put on a holder unit and set in an electric furnace. In nitrogen atmosphere, the sample is heated from 0 degrees C. to 150 degrees C. at a temperature rising rate of 10 degrees C./min, cooled from 150 degrees C. to 0 degrees C. at a temperature falling rate of 10 degrees C./min, and reheated to 150 degrees C. at a temperature rising rate of 10 degrees C./min, thus obtaining a DSC curve. The DSC curve is analyzed with analysis program installed in DSC-60 to determine a temperature at which the maximum peak of melting heat is observed in the second heating, and this temperature is identified as the melting point.

Preferably, the melt viscosity of the release agent is from 5 to 100 mPa·sec, more preferably from 5 to 50 mPa·sec, and most preferably from 5 to 20 mPa·sec, at 100 degrees C. When the melt viscosity is less than 5 mPa·sec, releasability may deteriorate. When the melt viscosity is greater than 100 mPa·sec, hot offset resistance and releasability at low temperatures may deteriorate.

The amount of the release agent contained in the toner is not particularly limited and may be appropriately selected depending on the purpose. Preferably, the amount of the release agent in 100 parts by mass of the toner is in the range of from 1 to 20 parts by mass, more preferably from 3 to 10 parts by mass. When the amount is from 1 to 20 parts by mass, the following undesirable phenomena can be prevented.

Deterioration of hot offset resistance.

Deterioration of heat-resistant storage stability, chargeability, transferability, and stress resistance.

Other Components

The toner may further contain other components which are appropriately selected according to the purpose without particular limitation as long as they are usable for ordinary toners. Examples thereof include, but are not limited to, a charge control agent and an external additive.

Charge Control Agent

The charge control agent is not particularly limited and may be appropriately selected depending on the purpose. Examples of the charge control agent include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives. Specific examples of the charge control agents include, but are not limited to: BONTRON 03 (nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), available from Orient Chemical Industries Co., Ltd.; TP-302 and TP-415 (molybdenum complexes of quaternary ammonium salts), available from Hodogaya Chemical Co., Ltd.; and LRA-901 and LR-147 (boron complex), available from Japan Carlit Co., Ltd.

The amount of the charge control agent contained in the toner is not particularly limited and may be appropriately selected according to the purpose. Preferably, the amount of the charge control agent in 100 parts by mass of the toner is in the range of from 0.01 to 5 parts by mass, more preferably from 0.02 to 2 parts by mass. When the amount is from 0.01 to 5 parts by mass, the following undesirable phenomena can be prevented.

Charge rising property and charge quantity are insufficient and toner image quality is adversely affected.

Chargeability of toner is so large that the electrostatic force between the toner and a developing roller is increased and fluidity of developer and image density are lowered.

External Additive

The external additive is not particularly limited and may be appropriately selected according to the purpose. Examples of the external additive include, but are not limited to, silica, metal salts of fatty acids, metal oxides, hydrophobized titanium oxides, and fluoropolymers.

Specific examples of the metal salts of fatty acids include, but are not limited to, zinc stearate and aluminum stearate.

Specific examples of the metal oxides include, but are not limited to, titanium oxide, aluminum oxide, tin oxide, and antimony oxide.

Specific examples of commercially-available products of silica include, but are not limited to, R972, R974, RX200, RY200, R202, R805, and R812 (available from Nippon Aerosil Co., Ltd.).

Specific examples of commercially-available products of titanium oxide include, but are not limited to: P-25 (available from Nippon Aerosil Co., Ltd.); STT-30 and STT-65C-S (available from Titan Kogyo, Ltd.); TAF-140 (available from Fuji Titanium Industry Co., Ltd.); and MT-150W, MT-500B, MT-600B, and MT-150A (available from TAYCA Corporation).

Specific examples of commercially-available products of hydrophobized titanium oxide include, but are not limited to: T-805 (available from Nippon Aerosil Co., Ltd.); STT-30A and STT-655-S (available from Titan Kogyo, Ltd.); TAF-500T and TAF-1500T (available from Fuji Titanium Industry Co., Ltd.); MT-100S and MT-100T (available from TAYCA Corporation); and IT-S (from Ishihara Sangyo Kaisha, Ltd.).

The hydrophobizing treatment can be performed by treating hydrophilic particles with a silane coupling agent such as methyl trimethoxysilane, methyl triethoxysilane, and octyl trimethoxysilane.

The amount of the external additive in the toner is not particularly limited and may be appropriately selected according to the purpose. Preferably, the amount of the external additive in 100 parts by mass of the toner is in the range of from 0.1 to 5 parts by mass, more preferably from 0.3 to 3 parts by mass.

The average particle diameter of the primary particles of the external additive is not particularly limited and may be appropriately selected according to the purpose, but is preferably 100 nm or less, and more preferably from 3 to 70 nm. When the average particle diameter falls below 3 nm, the external additive may be embedded in the toner and its function may not be effectively exhibited. When the average particle diameter exceeds 100 nm, the external additive may unevenly make flaws on the surface of a photoconductor.

Toner Properties

The toner according to an embodiment of the present invention has the following properties. (a) In a cross-section of the toner, the crystalline polyester resin forms domains having a number average long diameter of from 0 to 50 nm. (b) The toner satisfies the following relation: $G'(50)/G'(90) \geq 6.0\times10^2$, where G'(50) and G'(90) represent storage elastic modulus of the toner at 50 degrees C. and 90 degrees C., respectively.

Number Average Long Diameter of Domains of Crystalline Polyester Resin

In a cross-section of the toner, the crystalline polyester resin forms domains having a number average long diameter of from 0 to 50 nm, preferably from 0 to 10 nm. Hereinafter, the number average long diameter of domains of the crystalline polyester resin may be referred to as "crystalline polyester domain diameter". The crystalline polyester domain diameter of 0 nm refers to a state in which the crystalline polyester resin is dispersed with a fineness that is less than or equal to the detection limit of an electron microscopic measurement performed as described below. It does not refer to a state in which the toner contains no crystalline polyester resin.

The number average long diameter of domains of the crystalline polyester resin in a cross-section of the toner is an average of the long diameters of domains of the crystalline polyester resin in cross-sections of 50 toner particles. Cross-sections of toner particles to be observed are those in which the long diameter of the toner particle is in the range of ±20% of the number average particle diameter of the toner. The number average particle diameter of the toner is measured by a particle size distribution measuring instrument (MULTISIZER III available from Beckman Coulter, Inc.).

When the crystalline polyester domain diameter is larger than 50 nm, the contact area between the crystalline polyester and the other binder resin is insufficient and plasticization of the other binder resin by the crystalline polyester is insufficient, so that the toner may insufficiently express low-temperature fixability. Furthermore, the probability that the crystalline polyester is exposed at the surface of the toner is high, so that the toner may insufficiently express heat-resistant storage stability and mechanical durability.

The crystalline polyester domain diameter can be measured by observing a cross-section of a toner particle with a transmission electron microscope. The measurement procedure may be as follows.

[Sample Preparation]

(1) Toner is sufficiently dispersed in an epoxy resin which is curable at room temperature and allowed to stand for one day or more. The epoxy resin is then cured to obtain a cured product in which the toner is embedded.

(2) A cross-section of the cured product is made exposed using a microtome equipped with a diamond knife. The cured product with the cross-section exposed is immersed for 3 hours in an organic solvent (hexane) in which only the release agent is soluble, so that only domains of the release agent get dissolved.

(3) The cured product is thereafter dried for one day or more, a thin film section is then cut out under the following cutting conditions, and the obtained thin film section is stained with ruthenium tetroxide.

[Cutting Conditions]

Cutting thickness: 75 nm

Cutting speed: 0.05 to 0.2 mm/sec

Knife: Diamond knife (Ultra Sonic 35°)

A cross-sectional image of the toner is taken by a transmission electron microscope (TEM) at a magnification of 30,000 times. Toner components each having a different degree of crystallinity have been stained with ruthenium tetraoxide at different degrees to create image contrasts. Therefore, it is possible to identify domains of the crystalline resin contained in the toner. Generally, crystalline polyester is stained in a rod-like or line-like shape in cross-sections of toner, which is useful information for identification.

Observation with transmission electron microscope may be performed under the following conditions.

[Observation Conditions]

Instrument: Transmission electron microscope JEM-2100F available from JEOL Ltd.

Acceleration voltage: 200 kV

Morphological observation: Bright-field method

Settings: Spot size 3, CLAP 1, OLAP 3, Alpha 3

The obtained image is subjected to a binarization process (threshold 80/255 steps) using an image analysis software program "Image-J". A portion surrounded by a black boundary line through the binarization process is identified as a domain derived from the crystalline polyester.

The number average long diameter of domains of the crystalline polyester refers to the number average long diameter of domains of the crystalline polyester in the above-obtained TEM image.

In the present disclosure, the long diameter of a domain of the crystalline polyester is the longest diameter of the domain derived from the crystalline polyester. In a case in which the domain has an irregular shape, the long diameter is measured by a method which can measure the longest diameter.

Based on the TEM image, the number average long diameter of domains of the crystalline polyester is measured. More specifically, cross-sections of 50 toner particles are observed. Cross-sections of toner particles to be observed are those in which the long diameter of the toner particle is in the range of ±20% of the number average particle diameter of the toner. The number average particle diameter of the toner is measured by a particle size distribution measuring instrument (MULTISIZER III available from Beckman Coulter, Inc.). The long diameter is measured for all domains of the crystalline polyester present in each of the cross-sections of 50 toner particles, and the arithmetic mean value thereof is calculated. The obtained arithmetic mean value is taken as the number average long diameter of domains of the crystalline polyester.

In the present disclosure, the long diameter of domains of the crystalline polyester can also be confirmed in a phase image obtained by a scanning probe microscope (e.g., atomic force microscope (AFM)) in tapping mode. The tapping mode of AFM refers to a method described in Surface Science Letter, 290, 668 (1993). In this method, the surface profile of a sample is measured while vibrating a cantilever, as described in, for example, Polymer, 35, 5778 (1994) and Macromolecules, 28, 6773, (1995). Due to the viscoelastic property of the sample surface, a phase difference generates between a drive for vibrating the cantilever and the actual vibration. By mapping such phase differences, a phase image is obtained. Soft portions are observed to have a large phase delay. Hard portions are observed to have a small phase delay. Generally, the crystalline polyester resin is relatively softer than the other binder resin. Therefore, it is possible to identify a portion having a large phase difference as a domain of the crystalline polyester resin.

A specimen for obtaining the phase image can be prepared in the same manner as that for obtaining a cross-sectional image with a transmission electron microscope. As an example, the phase image based on AFM can be obtained with an instrument MFP-3D available from Asylum Research. Examples of the cantilever include OMCL-AC240TS-C3.

Measurement conditions are as follows.

Target amplitude: 0.5 V

Target percent: −5%

Amplitude setpoint: 315 mV

Scan rate: 1 Hz

Scan points: 256×256

Scan angle: 0°

Storage Elastic Modulus G'

The ratio (G'(50)/G'(90)) of the storage elastic modulus G'(50) at 50 degrees C. to the storage elastic modulus G'(90) at 90 degrees C. of the toner according to an embodiment of the present invention is $6.0\times10^2$ or higher. When the ratio is less than $6.0\times10^2$, the toner may not sufficiently express sharply-melting property, which is a property of rapidly melting in the fixable temperature range, while maintaining heat-resistant storage stability and mechanical durability at normal temperature. Preferably, the upper limit of the ratio is $9.0\times10^2$.

The storage elastic modulus (G') of the toner may be measured with a rheometer (ARES available from TA Instruments). Specifically, a measurement sample is molded into a pellet having a diameter of 8 mm and a thickness of 1 to 2 mm. The pellet is set between parallel plates having a diameter of 8 mm and stabilized at 40 degrees C. The temperature is then raised to 200 degrees C. at a temperature rising rate of 2.0 degrees C./min under a frequency of 1 Hz (6.28 rad/s) and a strain amount of 0.1% (strain amount control mode) to measure a storage elastic modulus.

Amount of Heat Absorption by Differential Scanning Calorimetry (DSC)

In the first temperature rising in differential scanning calorimetry (DSC), the toner preferably exhibits an endothermic peak indicating an amount of heat absorption of 3 J/g or more, more preferably 6 J/g or more, derived from the crystalline polyester resin. When the amount of heat absorption is 3 J/g or more, it is advantageous in terms of sharply-melting property of the toner. Preferably, the upper limit of the amount of heat absorption is 13 J/g.

The differential scanning calorimetry may be performed as follows.

Using a differential scanning calorimeter (DSC-60 available from Shimadzu Corporation), 5 mg of a sample weighed in an aluminum pan is cooled to 0 degrees C. at a temperature falling rate of 10 degrees C./min, then heated at a temperature rising rate of 10 degrees C./min, to measure the amount of heat absorption within a range of from 0 to 150 degrees C. from an endothermic peak. In some cases, it may be difficult to distinguish the endothermic peak derived from the crystalline polyester resin from the endothermic peak derived from a wax. To solve this problem, the wax may be extracted from the toner in advance by the method described below to isolate the endothermic peak derived from the crystalline polyester resin.

Method for Removing Wax Component in Toner

The method for removing wax components in the toner is not particularly limited and may be appropriately selected depending on the purpose, but preparative HPLC (high performance liquid chromatography) and Soxhlet extraction are preferable, and Soxhlet extraction is more preferable. For example, Soxhlet extraction may be performed as follows: 1 g of toner is weighed, placed in a cylindrical filter paper with No. 86R, put into a Soxhlet extractor, and subjected to Soxhlet extraction for 7 hours under reflux using 200 mL of hexane as a solvent. The resulting residue is washed with hexane, then dried under reduced pressure at 40 degrees C. for 24 hours and subsequently at 60 degrees C. for 24 hours, to remove the residual solvent.

Particle Diameter of Toner

The volume average particle diameter (Dv) of the toner according to an embodiment of the present invention is preferably from 3 to 8 μm. When the volume average particle diameter is from 3 to 8 μm, the following undesired phenomena can be prevented.

- In the case of a two-component developer, the toner fuses to the surface of a carrier during long-term stirring in a developing device, which reduces chargeability of the carrier.
- In the case of a one-component developer, the toner easily forms its film on a developing roller or fuses to a toner layer thinning member such as a blade.
- Fluctuation of toner particle diameter increases through consumption and supply of the toner in the developer, which makes it difficult to obtain high-resolution high-quality images.

The ratio (Dv/Dn) of the volume average particle diameter (Dv) to the number average particle diameter (Dn) of the toner is preferably from 1.00 to 1.25.

When the ratio (Dv/Dn) of the volume average particle diameter to the number average particle diameter is from 1.00 to 1.25, the following undesired phenomena can be prevented.

- In the case of a two-component developer, the toner fuses to the surface of a carrier during long-term stirring in a developing device, which reduces chargeability of the carrier and cleanability.
- In the case of a one-component developer, the toner easily forms its film on a developing roller or fuses to a toner layer thinning member such as a blade.
- When the ratio (Dv/Dn) is in excess of 1.25, fluctuation of toner particle diameter increases through consumption and supply of the toner in the developer, which makes it difficult to obtain high-resolution high-quality images.

The volume average particle diameter (Dv) and the number average particle diameter (Dn) can be measured by a Coulter counter method. Examples of measuring instruments include, but are not limited to, COULTER COUNTER TA-II and COULTER MULTISIZER II (both manufactured by Beckman Coulter, Inc.).

The measurement method is as follows.

First, 0.1 to 5 mL of a surfactant (preferably an alkylbenzene sulfonate), as a dispersant, is added to 100 to 150 mL of an electrolyte solution. Here, the electrolyte solution is an about 1% by mass NaCl aqueous solution prepared with the first grade sodium chloride, such as ISOTON-II (available from Beckman Coulter, Inc.). A sample in an amount of from 2 to 20 mg is then added thereto. The electrolyte solution, in which the sample is suspended, is subjected to a dispersion treatment with an ultrasonic disperser for about 1 to 3 minutes. The electrolyte solution is thereafter subjected to a measurement of the volume and number of toner particles with the above measuring instrument equipped with a 100 μm aperture, to calculate volume and number distributions. The volume average particle diameter (Dv) and number average particle diameter (Dn) are calculated from the volume and number distributions, respectively, measured above.

Thirteen channels with the following ranges are used for the measurement: not less than 2.00 μm and less than 2.52 μm; not less than 2.52 μm and less than 3.17 μm; not less than 3.17 μm and less than 4.00 μm; not less than 4.00 μm and less than 5.04 μm; not less than 5.04 μm and less than 6.35 μm; not less than 6.35 μm and less than 8.00 μm; not less than 8.00 μm and less than 10.08 μm; not less than 10.08 μm and less than 12.70 μm; not less than 12.70 μm and less than 16.00 μm; not less than 16.00 μm and less than 20.20 μm; not less than 20.20 μm and less than 25.40 μm; not less than 25.40 μm and less than 32.00 μm; and not less than 32.00 μm and less than 40.30 μm. Namely, particles having a particle diameter not less than 2.00 μm and less than 40.30 μm are to be measured.

Method for Manufacturing Toner

The method for manufacturing the toner is not particularly limited and may be appropriately selected according to the purpose. Examples thereof include, but are not limited to, a wet granulation method and a pulverization method. Specific examples of the wet granulation method include, but are not limited to, a dissolution suspension method and an emulsion aggregation method. The dissolution suspension method and the emulsion aggregation method are preferable because these methods do not have the process of kneading the binder resin, which is free from the problem of molecular cut caused through kneading or the difficulty in uniformly kneading of high-molecular-weight resin with low-molecular-weight resin. The dissolution suspension method is more preferable for uniformity of the binder resin in the toner particles.

Dissolution Suspension Method

The dissolution suspension method includes a process of preparing a toner material phase, a process of preparing an aqueous medium phase, a process of preparing an emulsion or liquid dispersion, and a process of removing an organic solvent, and optionally includes other processes, as necessary.

Process of Preparing Toner Material Phase (Oil Phase)

The process of preparing a toner material phase is not particularly limited and can be appropriately selected according to the purpose as long as toner materials including at least the binder resin and optionally the colorant and the release agent are dissolved or dispersed in an organic solvent to prepare a solution or liquid dispersion of the toner materials (hereinafter "toner material phase" or "oil phase").

The organic solvent is not particularly limited and may be appropriately selected according to the purpose. Preferably, the organic solvent is a volatile solvent having a boiling point of less than 150° C., which is easily removable.

Specific examples of the organic solvent include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Among these solvents, ethyl acetate, toluene, xylene, benzene, methylene chloride, 1,2-dichloroethane, chloroform, and carbon tetraoxide are preferable, and ethyl acetate is most preferable.

Each of these materials can be used alone or in combination with others.

The amount of the organic solvent to be used is not particularly limited and may be appropriately selected according to the purpose, but is preferably 300 parts by mass or less, more preferably 100 parts by mass or less, and most preferably from 25 to 70 parts by mass, based on 100 parts by mass of the toner materials.

Process of Preparing Aqueous Medium Phase (Aqueous Phase)

The process of preparing an aqueous medium phase is not particularly limited and can be appropriately selected depending on the purpose as long as an aqueous medium phase is prepared. In this process, it is preferable that an aqueous medium phase is prepared by incorporating fine resin particles in an aqueous medium.

The aqueous medium is not particularly limited and may be appropriately selected according to the purpose. Specific examples of the aqueous medium include, but are not limited to, water, a water-miscible solvent, and a mixture thereof. Among these aqueous media, water is particularly preferable.

Specific examples of the water-miscible solvent include, but are not limited to, an alcohol, dimethylformamide, tetrahydrofuran, a cellosolve, and a lower ketone.

Specific examples of the alcohol include, but are not limited to, methanol, isopropanol, and ethylene glycol.

Specific examples of the lower ketone include, but are not limited to, acetone and methyl ethyl ketone.

Each of these materials can be used alone or in combination with others.

The aqueous medium phase may be prepared by dispersing the fine resin particles in the aqueous medium in the presence of a surfactant. The reason for adding the surfactant and the fine resin particles in the aqueous medium is to improve dispersibility of the toner materials.

The amount of each of the surfactant and the fine resin particles to be added to the aqueous medium is not particularly limited and may be appropriately selected according to the purpose, but is preferably from 0.5% to 10% by mass based on the aqueous medium.

The surfactant is not particularly limited and may be appropriately selected according to the purpose. Specific examples of the surfactant include, but are not limited to, an anionic surfactant, a cationic surfactant, and an ampholytic surfactant.

Specific examples of the anionic surfactant include, but are not limited to, fatty acid salt, alkyl sulfate, alkyl aryl sulfonate, alkyl diaryl ether disulfonate, dialkyl sulfosuccinate, alkyl phosphate, naphthalene sulfonic acid formalin condensate, polyoxyethylene alkyl phosphate, and glyceryl borate fatty acid ester.

The fine resin particles are not limited in the type of resin as long as an aqueous dispersion thereof is obtainable. Usable resins include both thermoplastic resins and thermosetting resins. Specific examples of resins usable for the fine resin particles include, but are not limited to, vinyl resin, polyurethane resin, epoxy resin, polyester resin, polyamide resin, polyimide resin, silicone resin, phenol resin, melamine resin, urea resin, aniline resin, ionomer resin, and polycarbonate resin. Each of these materials can be used alone or in combination with others.

Among these resins, vinyl resin, polyurethane resin, epoxy resin, polyester resin, and combinations thereof are preferable because an aqueous dispersion of fine spherical particles thereof is easily obtainable.

Specific examples of the vinyl resin include, but are not limited to, homopolymers and copolymers of vinyl monomers, such as styrene-acrylate copolymer, styrene-methacrylate copolymer, styrene-butadiene copolymer, acrylic acid-acrylate copolymer, methacrylic acid-acrylate copolymer, styrene-acrylonitrile copolymer, styrene-maleic anhydride copolymer, styrene-acrylic acid copolymer, and styrene-methacrylic acid copolymer.

The average particle diameter of the fine resin particles is not particularly limited and may be appropriately selected according to the purpose, but is preferably from 5 to 300 nm, and more preferably from 20 to 200 nm.

In preparing the aqueous medium phase, cellulose can be used as a dispersant. Specific examples of the cellulose include, but are not limited to, methyl cellulose, hydroxyethyl cellulose, hydroxypropyl cellulose, and carboxymethylcellulose sodium.

Process of Preparing Emulsion or Liquid Dispersion

The process of preparing an emulsion or liquid dispersion is not particularly limited and can be appropriately selected depending on the purpose as long as the solution or liquid dispersion of the toner materials (i.e., the toner material phase) is emulsified or dispersed in the aqueous medium phase to prepare an emulsion or liquid dispersion.

The process of emulsification or dispersion is not particularly limited and can be appropriately selected according to the purpose, and may be performed with a known disperser.

Specific examples of the disperser include, but are not limited to, a low-speed shearing disperser and a high-speed shearing disperser.

The amount of the aqueous medium phase to be used is not particularly limited and may be appropriately selected according to the purpose, but is preferably from 50 to 2,000 parts by mass, more preferably from 100 to 1,000 parts by mass, based on 100 parts by mass of the toner material phase. When the amount used is from 50 to 2,000 parts by mass, the following undesirable phenomena can be prevented.

The dispersion state of the toner material phase is so poor that toner particles having a desired particle size cannot be obtained.

Being uneconomical.

Process of Removing Organic Solvent

The process of removing an organic solvent is not particularly limited and can be appropriately selected according to the purpose as long as the organic solvent is removed from the emulsion or liquid dispersion to obtain a solvent-free slurry.

The organic solvent can be removed by (1) gradually heating the whole reaction system to completely evaporate the organic solvent from oil droplets in the emulsion or liquid dispersion or (2) spraying the emulsion or liquid dispersion into a dry atmosphere to completely evaporate the organic solvent from oil droplets in the emulsion or liquid dispersion. Upon removal of the organic solvent, toner particles are formed.

Other Processes

The other processes may include, for example, a washing process and a drying process.

Washing Process

The washing process is not particularly limited and can be appropriately selected according to the purpose as long as the solvent-free slurry is washed with water after the process of removing the organic solvent. Specific examples of the water include, but are not limited to, ion-exchange water.

Drying Process

The drying process is not particularly limited and can be appropriately selected according to the purpose as long as toner particles obtained in the washing process are dried.

Pulverization Method

The pulverization method is a method for producing mother toner particles through the processes of melt-kneading toner materials including at least the binder resin, pulverizing the kneaded product, and classifying the pulverized product.

In the melt-kneading process, a mixture of the toner materials is melt-kneaded by a melt-kneader. Specific examples of the melt-kneader include, but are not limited to, a single-axis or double-axis continuous kneader and a batch kneader using roll mill. Specific examples of commercially available products of the melt-kneader include, but are not limited to, TWIN SCREW EXTRUDER KTK from Kobe Steel, Ltd., TWIN SCREW COMPOUNDER TEM from Toshiba Machine Co., Ltd., MIRACLE K.C.K from Asada Iron Works Co., Ltd., TWIN SCREW EXTRUDER PCM from Ikegai Co., Ltd., and KOKNEADER from Buss Corporation. Preferably, the melt-kneading process is performed under an appropriate condition such that the molecular chains of the binder resin are not cut. Specifically, the melt-kneading temperature is determined with reference to the softening point of the binder resin. When the melt-kneading temperature is excessively higher than the softening point, molecular chains may be significantly cut. When the melt-kneading temperature is excessively lower than the softening point, toner components may not be well dispersed therein.

In the pulverizing process, the melt-kneaded product is pulverized. Preferably, the kneaded product is first pulverized into coarse particles, and the coarse particles are then pulverized into fine particles. Suitable pulverization methods include a method which collides particles with a collision board in a jet stream; a method which collides particles with each other in a jet stream; and a method which pulverizes particles in a narrow gap formed between a rotor mechanically rotating and a stator.

In the classifying process, the pulverized product is adjusted to have a predetermined particle diameter. In the classifying process, ultrafine particles are removed by means of cyclone separator, decantation, or centrifugal separator.

Developer

A developer according to an embodiment of the present invention contains the toner according to an embodiment of the present invention. The developer may be either a one-component developer or a two-component developer in which the toner is mixed a carrier. To be used for a high-speed printer corresponding to a recent improvement in information processing speed, the two-component developer is more preferable for extending the lifespan of the printer.

In the case of a one-component developer, even when toner supply and toner consumption are repeatedly performed, the particle diameter of the toner fluctuates very little. In addition, neither toner filming on a developing roller nor toner fusing to a layer thickness regulating member (e.g., a blade for forming a thin layer of toner) occurs. Thus, even when the developer is used (stirred) in a developing device for a long period of time, developability and image quality remain good and stable.

In the case of a two-component developer, even when toner supply and toner consumption are repeatedly performed for a long period of time, the particle diameter of the toner fluctuates very little. Thus, even when the developer is stirred in a developing device for a long period of time, developability and image quality remain good and stable.

The developer according to an embodiment of the present invention can also be used as a developer for replenishment.

Carrier

The carrier is not particularly limited and may be appropriately selected according to the purpose. Preferably, the carrier comprises a core material and a resin layer covering the core material.

Core Material

The core material is not particularly limited and may be appropriately selected according to the purpose. Specific examples of the core material include, but are not limited to, ferrite, magnetite, iron, and nickel. With respect to ferrite, considering the attention to environmental applicability that is remarkably increasing recently, manganese ferrite, manganese-magnesium ferrite, manganese-strontium ferrite, manganese-magnesium-strontium ferrite, and lithium ferrite are more preferred rather than copper-zinc ferrite that has been conventionally used.

Resin Layer

Specific examples of resins usable for the resin layer include, but are not limited to, amino resin, polyvinyl resin, polystyrene resin, halogenated olefin resin, polyester resin, polycarbonate resin, polyethylene resin, polyvinyl fluoride resin, polyvinylidene fluoride resin, polytrifluoroethylene resin, polyhexafluoropropylene resin, copolymer of vinylidene fluoride with an acrylic monomer, copolymer of vinylidene fluoride with vinyl fluoride, fluoroterpolymer (e.g., terpolymer of tetrafluoroethylene, vinylidene fluoride, and non-fluoride monomer), and silicone resin. Each of these materials can be used alone or in combination with others.

Specific examples of the silicone resin include, but are not limited to: a straight silicone resin consisting of organosiloxane bonds only; and a modified silicone resin modified with alkyd resin, polyester resin, epoxy resin, acrylic resin, or urethane resin.

Commercially-available products of the silicone resin can also be used.

Specific examples of the straight silicone resin include, but are not limited to: KR271, KR255, and KR152 (available from Shin-Etsu Chemical Co., Ltd.); and SR2400, SR2406, and SR2410 (available from Dow Corning Toray Co., Ltd.).

Specific examples of the modified silicone resin include, but are not limited to: KR-206 (alkyd-modified silicone resin), KR-5208 (acrylic-modified silicone resin), ES-1001N (epoxy-modified silicone resin), and KR-305 (urethane-modified silicone resin), each available from Shin-Etsu Chemical Co., Ltd.); and SR2115 (epoxy-modified silicone resin) and SR2110 (alkyd-modified silicone resin), each available from Dow Corning Toray Co., Ltd.).

The silicone resin may be used alone or in combination with a cross-linkable component and/or a charge amount controlling agent.

Preferably, the proportion of components forming the resin layer in the carrier is from 0.01% to 5.0% by mass. When the proportion is from 0.01 to 5.0% by mass, the following undesirable phenomena can be prevented.

- The resin layer cannot be uniformly formed on the surface of the core material.
- The resin layer becomes so thick that coalescence of carrier particles occurs without forming uniform carrier particles.

The amount of the toner contained in the two-component developer is not particularly limited and may be appropriately selected according to the purpose. Preferably, the amount of the toner in 100 parts by mass of the carrier is from 2.0 to 12.0 parts by mass, more preferably from 2.5 to 10.0 parts by mass.

Toner Accommodating Unit

In the present disclosure, a toner accommodating unit refers to a unit having a function of accommodating toner and accommodating the toner. The toner accommodating unit may be in the form of, for example, a toner container, a developing device, or a process cartridge.

The toner container refers to a container containing the toner.

The developing device refers to a device containing the toner and having a developing unit configured to develop an electrostatic latent image into a toner image with the toner.

The process cartridge refers to a combined body of an electrostatic latent image bearer (also referred to as an image bearer) with a developing unit containing the toner, detachably mountable on an image forming apparatus. The process cartridge may further include at least one of a charger, an irradiator, and a cleaner.

An image forming apparatus in which the toner accommodating unit is installed can reliably form high-quality high-definition images for an extended period of time, utilizing the above-described toner that provides both low-temperature fixability and heat-resistant storage stability.

Image Forming Apparatus and Image Forming Method

An image forming apparatus according to an embodiment of the present invention includes at least an electrostatic latent image bearer, an electrostatic latent image forming device, and a developing device, and optionally other devices.

An image forming method according to an embodiment of the present invention includes at least an electrostatic latent image forming process and a developing process, and optionally other processes.

The image forming method is preferably performed by the image forming apparatus. The electrostatic latent image forming process is preferably performed by the electrostatic latent image forming device. The developing process is preferably performed by the developing device. Other optional processes are preferably performed by other optional devices.

More preferably, the image forming apparatus includes: an electrostatic latent image bearer; an electrostatic latent image forming device configured to form an electrostatic latent image on the electrostatic latent image bearer; a developing device containing the above-described toner, configured to develop the electrostatic latent image formed on the electrostatic latent image bearer with the toner to form a toner image; a transfer device configured to transfer the toner image formed on the electrostatic latent image bearer onto a surface of a recording medium; and a fixing device configured to fix the toner image on the surface of the recording medium.

More preferably, the image forming method includes: an electrostatic latent image forming process in which an electrostatic latent image is formed on an electrostatic latent image bearer; a developing process in which the electrostatic latent image formed on the electrostatic latent image bearer is developed with the above-described toner to form a toner image; a transfer process in which the toner image formed on the electrostatic latent image bearer is transferred onto a surface of a recording medium; and a fixing process in which the toner image is fixed on the surface of the recording medium.

In the developing device and the developing process, the above-described toner is used. Preferably, the toner image is formed with a developer containing the above-described toner and other components such as a carrier.

Electrostatic Latent Image Bearer

The electrostatic latent image bearer (also referred to as "photoconductor") is not limited in material, structure, and size, and can be appropriately selected from known materials. Specific examples of the materials include, but are not limited to, inorganic photoconductors such as amorphous silicon and selenium, and organic photoconductors such as polysilane and phthalopolymethine.

Electrostatic Latent Image Forming Device

The electrostatic latent image forming device is not particularly limited and can be appropriately selected according to the purpose as long as it is capable of forming an electrostatic latent image on the electrostatic latent image bearer. For example, the electrostatic latent image forming device may include a charger to uniformly charge a surface of the electrostatic latent image bearer and an irradiator to irradiate the surface of the electrostatic latent image bearer with light containing image information.

Developing Device

The developing device is not particularly limited and can be appropriately selected according to the purpose, as long as it is storing a toner and configured to develop the electrostatic latent image formed on the electrostatic latent image bearer into a visible image with the toner.

Other Devices

Examples of the other optional devices include, but are not limited to, a transfer device, a fixing device, a cleaner, a neutralizer, a recycler, and a controller.

Preferably, the image forming apparatus according to an embodiment of the present invention has no lubricant application device. The lubricant application device here refers to a device that applies a lubricant to a photoconductor.

The lubricant is applied to the surface of the photoconductor. Examples of the lubricant include, but are not limited to, zinc stearate.

The purposes for applying the lubricant include the following.

To lower the friction coefficient μ to stabilize the behavior of a cleaning blade edge to assist a cleaner.

To protect the surface of the photoconductor from a charging current when an alternating current voltage is applied to a charging roller.

To prevent adhesion of toner components to an image bearer and contamination by external additives or paper powder by scraping the lubricant applied to the surface of the image bearer with a cleaning blade.

The lubricant may be applied to the surface of an image bearer with a brush roller. Specifically, an application brush scratches a solid lubricant (block lubricant) and applies the scratched lubricant to the surface of the image bearer.

Generally, in an image forming apparatus free of lubricant application device, the behavior of the cleaning blade edge is unstable to cause cleaning failure. Moreover, the cleaning blade directly contacts the image bearer to increase surface abrasion.

On the other hand, in the image forming apparatus according to an embodiment of the present invention, such a cleaning failure is not likely to occur since the external additive has high irregularity.

An image forming apparatus according to an embodiment of the present invention is described below with reference to the drawing.

One example of the image forming apparatus is illustrated in the drawing. Around a photoconductor drum (hereinafter "photoconductor") 110 as an image bearer, a charging roller 120 as a charger, an irradiator 130, a cleaner 160 having a cleaning blade, a neutralizing lamp 170 as a neutralizer, a developing device 140, and an intermediate transferor 150 are provided. The intermediate transferor 150 is suspended by a plurality of suspension rollers 151 and is configured to travel endlessly in the direction indicated by arrow in the drawing by a driver such as a motor. A part of the suspension rollers 151 also serves as a transfer bias roller for supplying a transfer bias to the intermediate transferor 150, and is applied with a predetermined transfer bias voltage from a power source. Further, a cleaner 190 having a cleaning blade is also provided for cleaning the intermediate transferor 150. A transfer roller 180 is disposed facing the intermediate transferor 150, as a transfer device for transferring a developed image onto a transfer sheet 1100 as a final transfer material. The transfer roller 180 is supplied with a transfer bias from a power source. Around the intermediate transferor 150, a corona charger 152 as a charge applying device is provided.

The developing device 140 includes a developing belt 141 serving as a developer bearer; and a black (Bk) developing unit 145K, a yellow (Y) developing unit 145Y, a magenta (M) developing unit 145M, and a cyan (C) developing unit 145C each disposed around the developing belt 141.

The developing belt 141 is stretched over a plurality of belt rollers and is configured to travel endlessly in the direction indicated by arrow in the drawing by a driver such as a motor. The developing belt 141 moves at almost the same speed as the photoconductor 110 at the contact portion with the photoconductor 110.

Since the configuration of each developing unit is the same, the following description is made only for the Bk developing unit 145K. In the drawing, the symbols Y, M, and C are added to the numbers given to the units in the respective developing units 145Y, 145M, and 145C corresponding to those in the Bk developing unit 145K, and the explanation is omitted. The Bk developing unit 145K includes: a developing tank 142K storing a high-viscosity high-concentration liquid developer containing toner particles and a carrier liquid; a drawing roller 143K disposed such that the lower part thereof is immersed in the liquid developer in the developing tank 142K; and an application roller 144K for thinning the developer drawn up from the drawing roller 143K and applying it to the developing belt 141. The application roller 144K is conductive and applied with a predetermined bias from a power source.

Next, an operation of the image forming apparatus is described below. Referring to the drawing, the photoconductor 110 is uniformly charged by the charging roller 120 while rotating in the direction indicated by arrow in the drawing, and the irradiator 130 then forms an image with light reflected from a document through an optical system, thus forming an electrostatic latent image on the photoconductor 110. The electrostatic latent image is developed into a toner image as a visible image by the developing device 140. The developer layer on the developing belt 141 is peeled off from the developing belt 141 in a thin layer state by contact with the photoconductor 110 in the developing region, then transferred onto the portion on the photoconductor 110 where the latent image is formed. The toner image developed by the developing device 140 is transferred onto the surface of the intermediate transferor 150 (i.e., primary transfer) at the contact portion with the intermediate transferor 150 (i.e., primary transfer region) where the intermediate transferor 150 is moving at the same speed as the photoconductor 110. In the case of superimposing three or four colors, this transfer process is repeated for each color to form a composite color image on the intermediate transferor 150.

The corona charger 152 for applying a charge to the composite toner image on the intermediate transferor 150 is provided downstream of the contact portion of the photoconductor 110 with the intermediate transferor 150 and upstream of the contact portion of the intermediate transferor 150 with the transfer sheet 1100 with respect to the direction of rotation of the intermediate transferor 150. The corona charger 152 then imparts to the toner image a true charge of the same polarity as the charge polarity of toner particles constituting the toner image, so that the toner image is supplied with a charge sufficient for being transferred onto the transfer sheet 1100. The toner image charged by the corona charger 152 is then transferred in a collective manner (i.e., secondary transfer) onto the transfer sheet 1100 that is conveyed from a sheet feeder in the direction indicated by arrow in the drawing by a transfer bias from the transfer roller 180. The transfer sheet 1100 onto which the toner image has been transferred is separated from the photoconductor 110 by a separation device, subjected to a fixing process by a fixing device, and ejected from the apparatus. On the other hand, after the image transfer, the untransferred toner particles remaining on the photoconductor 110 are removed by the cleaner 160 and the residual charge is removed by the neutralizing lamp 170 in preparation for the next charging. A color image is usually formed of four color toners. In one color image, one to four toner layers are formed. The toner layers go through the primary transfer (transfer from the photoconductor onto the intermediate transfer belt) and the secondary transfer (transfer from the intermediate transfer belt onto the sheet).

EXAMPLES

Having generally described this invention, further understanding can be obtained by reference to certain specific examples which are provided herein for the purpose of illustration only and are not intended to be limiting. In the following descriptions, "parts" represents "parts by mass" unless otherwise specified.

Preparation of Amorphous Resin A1

A 5-liter four-neck flask equipped with a nitrogen introducing tube, a dewatering tube, a stirrer, and a thermocouple was charged with propylene glycol (as a diol) and dimethyl terephthalate and dimethyl adipate (as dicarboxylic acids) such that the molar ratio of dimethyl terephthalate to dimethyl adipate became 90/10 and the ratio (OH/COOH) of OH groups to COOH groups became 1.2. These raw materials were allowed to react in the presence of 300 ppm (based on the total mass of the raw materials) of titanium tetraisopropoxide while the produced methanol was allowed to flow out. The temperature was finally raised to 230 degrees C. and the reaction was continued until the acid value of the produced resin became 5 mgKOH/g or less. The reaction was further continued under reduced pressures of from 20 to 30 mmHg until Mw reached 15,000. Subsequently, the reaction temperature was reduced to 180 degrees C. and trimellitic anhydride was added. Thus, an amorphous resin A1 that was an amorphous polyester resin having a carboxylic acid on its terminal was prepared.

Preparation of Amorphous Resins A2 and A3

Amorphous resins A2 and A3 were prepared in the same manner as the amorphous resin A1 except for replacing the dicarboxylic acid and the diol with those described in Table 1.

TABLE 1

| | | Amorphous Resin | | |
|---|---|---|---|---|
| | | A1 | A2 | A3 |
| Diols | Propylene Glycol | 100 | 60 | — |
| | EO Adduct of Bisphenol A | — | 40 | 100 |
| Dicarboxylic | Dimethyl Terephthalate | 90 | 85 | 80 |
| Acids | Dimethyl Adipate | 10 | 15 | 20 |
| Molecular Weight (Mw) | | 15000 | 16000 | 16000 |
| Tg (deg. C.) | | 57 | 58 | 58 |

In Table 1, "BisA-EO" represents ethylene oxide adduct of bisphenol A.

In Table 1, the unit for numerical values of diols and dicarboxylic acids is "part by mass".

Preparation of Amorphous Resin B

A reaction vessel equipped with a condenser tube, a stirrer, and a nitrogen introducing tube was charged with diol components comprising 100% by mol of 3-methyl-1,5-pentanediol, dicarboxylic acid components comprising 50% by mol of isophthalic acid and 50% by mol of adipic acid, and 1% by mol (based on all monomers) of trimellitic anhydride, along with 1,000 ppm (based on the resin (monomer) components) of titanium tetraisopropoxide, such that the molar ratio (OH/COOH) of OH groups to COOH groups became 1.5.

The vessel contents were heated to 200 degrees C. over a period of about 4 hours, thereafter heated to 230 degrees C. over a period of 2 hours, and the reaction was continued until outflow water was no more produced.

The vessel contents were further allowed to react under reduced pressures of from 10 to 15 mmHg for 5 hours. Thus, an intermediate polyester resin was prepared.

Next, a reaction vessel equipped with a condenser tube, a stirrer, and a nitrogen introducing tube was charged with the intermediate polyester and isophorone diisocyanate such that the molar ratio of the intermediate polyester to the isophorone diisocyanate became 2.0. The vessel contents were diluted to 50% by mass with ethyl acetate and further allowed to react at 100 degrees C. for 5 hours. Thus, an amorphous resin B was prepared.

Preparation of Crystalline Polyester Resin C1

A 5-liter four-neck flask equipped with a nitrogen introducing tube, a dewatering tube, a stirrer, and a thermocouple was charged with 1,10-decanediol and dimethyl sebacate such that the ratio (OH/COOH) of OH groups to COOH groups became 1.1. These raw materials were allowed to react in the presence of 300 ppm (based on the total mass of the raw materials) of titanium tetraisopropoxide while the produced water was allowed to flow out. The temperature was finally raised to 230 degrees C. and the reaction was continued until the acid value of the produced resin became 5 mgKOH/g or less. The reaction was further continued for 6 hours under reduced pressures of 10 mmHg or less. Thus, a crystalline polyester resin C1 was prepared.

Preparation of Crystalline Polyester Resins C2 to C5

Crystalline polyester resins C2 to C5 were prepared in the same manner as the crystalline polyester resin C1 except for replacing the dicarboxylic acid and the diol with those described in Table 2.

TABLE 2

| | | Crystalline Polyester Resin | | | | |
|---|---|---|---|---|---|---|
| | | C1 | C2 | C3 | C4 | C5 |
| Diols | 1,10-Decanediol | 100 | 100 | — | — | — |
| | 1,6-Hexanediol | — | — | 100 | — | — |
| | 1,4-Butanediol | — | — | — | 100 | — |
| | 1,2-Ethanediol | — | — | — | — | 100 |
| Dicarboxylic | Dimethyl Sebacate | 100 | — | 100 | 100 | 100 |
| Acids | Dimethyl Dodecanoate | — | 100 | — | — | — |
| Molecular Weight (Mw) | | 15000 | 15000 | 16000 | 16000 | 16000 |
| Melting point (deg. C.) | | 75 | 85 | 66 | 62 | 71 |

In Table 2, the unit for numerical values of diols and dicarboxylic acids is "part by mass".

Preparation of Wax Dispersing Agent

An autoclave equipped with a thermometer and a stirrer was charged with 70 parts of a low-molecular polyethylene (SANWAX 151P available from Sanyo Chemical Industries, Ltd.) having a melting point of 108 degrees C. and 480 parts of xylene and heated to 170 degrees C. The air inside the autoclave was thereafter replaced with nitrogen gas.

Next, a solution in which 805 parts of styrene, 50 parts of acrylonitrile, 45 parts of butyl acrylate, and 36 parts of di-t-butyl peroxide were dissolved in 100 parts of xylene was dropped in the autoclave over a period of 3 hours and the temperature was kept at 170 degrees C. for 30 minutes, followed by solvent removal. Thus, a was dispersing agent was prepared.

Preparation of Resin Particle Dispersion Liquid

In a reaction vessel equipped with a stirrer and a thermometer, 683 parts of water, 11 parts of a sodium salt of a sulfate of ethylene oxide adduct of methacrylic acid (ELEMINOL RS-30 available from Sanyo Chemical Industries, Ltd.), 138 parts of styrene, 138 parts of methacrylic acid, and 1 part of ammonium persulfate were stirred at 400 rpm for 15 minutes, heated to 75 degrees C., and maintained for 5 hours.

Next, 30 parts of a 1% by mass aqueous solution of ammonium persulfate was added to the vessel, and an aging was performed at 75 degrees for 5 hours. Thus, a resin particle dispersion liquid 1 was prepared.

The particle size distribution of the resin particle dispersion liquid 1 was measured by a laser diffraction particle size distribution analyzer LA-920 (available from Horiba, Ltd.), and the volume average particle diameter was determined as 0.14 μm.

Preparation of Aqueous Phase 1

An aqueous phase 1 was prepared by mixing 990 parts of water, 83 parts of the resin particle dispersion liquid 1, 37 parts of a 48.5% by mass aqueous solution of dodecyl diphenyl ether sodium disulfonate (ELEMINOL MON-7 available from Sanyo Chemical Industries, Ltd.), and 90 parts of ethyl acetate.

Preparation of Wax Dispersion Liquid

A reaction vessel equipped with a condenser tube, a thermometer, and a stirrer was charged with 130 parts of a paraffin wax (HNP-9 available from Nippon Seiro Co., Ltd., having a melting point of 75 degrees C.), 70 parts of the wax dispersing agent, and 800 parts of ethyl acetate. These materials were heated to 78 degrees C. so that the wax was well dissolved in the ethyl acetate, and then cooled to 30 degrees C. over a period of 1 hour while being stirred. The resulting liquid was subjected to a wet pulverization treatment using an ULTRAVISCOMILL (from Aimex Co., Ltd.) filled with 80% by volume of zirconia beads having a diameter of 0.5 mm, at a liquid feeding speed of 1.0 kg/hour and a disc peripheral speed of 10 m/sec. This dispersing operation was repeated 6 times (6 passes). An amount of ethyl acetate was added to adjust the solid content concentration. Thus, a wax dispersion liquid 1 having a solid content concentration of 20% was prepared.

Preparation of Colorant Master Batch

First, 1,200 parts of water, 540 parts of a carbon black (PRINTEX 35 manufactured by Degussa, having a DBP oil absorption of 42 mL/100 mg and a pH of 9.5), and 1,200 parts of the amorphous resin A1 were mixed with a HENSCHEL MIXER (manufactured by Mitsui Mining and Smelting Co., Ltd.). The mixture was kneaded with a double roll at 150 degrees C. for 30 minutes, thereafter rolled to cool, and pulverized with a pulverizer. Thus, a colorant master batch was prepared.

Preparation of Crystalline Polyester Resin Master Batch 1

First, 800 parts of the amorphous resin A1 and 200 parts of the crystalline polyester resin C1 were mixed with a HENSCHEL MIXER (manufactured by Mitsui Mining and Smelting Co., Ltd.). The mixture was kneaded with a double roll at 100 degrees C. for 10 minutes, thereafter rolled to cool, and pulverized with a pulverizer. Thus, a crystalline polyester resin master batch 1 was prepared.

Preparation of Crystalline Polyester Resin Master Batches 2 to 7

Crystalline polyester resin master batches 2 to 7 were prepared in the same manner as the crystalline polyester resin master batch 1 except for replacing the combination of the resins with those described in Table 3.

TABLE 3

| | Crystalline Polyester | Amorphous Polyester |
|---|---|---|
| Crystalline Polyester Master Batch 1 | C1 | A1 |
| Crystalline Polyester Master Batch 2 | C1 | A2 |
| Crystalline Polyester Master Batch 3 | C2 | A1 |
| Crystalline Polyester Master Batch 4 | C3 | A1 |
| Crystalline Polyester Master Batch 5 | C4 | A1 |
| Crystalline Polyester Master Batch 6 | C1 | A3 |
| Crystalline Polyester Master Batch 7 | C5 | A1 |

Example 1

Preparation of Toner 1

Preparation of Oil Phase

In a vessel, 750 parts of the amorphous resin A1, 460 parts of the crystalline polyester resin master batch 1, 1,100 parts of the wax dispersion liquid 1, 10 parts of the amorphous resin B, and 100 parts of the colorant master batch 1 were mixed with a TK HOMOMIXER (available from PRIMIX Corporation) at a revolution of 7,000 rpm for 60 minutes. Thus, an oil phase 1 was prepared.

Emulsification and Solvent Removal

In the vessel containing the oil phase 1, 3,000 parts of the aqueous phase 1 was added and mixed with the oil phase 1 by a TK HOMOMIXER at a revolution of 8,000 rpm for 5 minutes. Thus, an emulsion slurry 1 was prepared.

The emulsion slurry 1 was put in a vessel equipped with a stirrer and a thermometer and subjected to solvent removal at 30 degrees C. for 8 hours and subsequently to aging at 45 degrees C. for 4 hours. Thus, a dispersion slurry 1 was prepared.

Washing and Drying

After 100 parts of the dispersion slurry 1 was filtered under reduced pressures:

(1) The filter cake was mixed with 100 parts of ion-exchange water using a TK HOMOMIXER at a revolution of 12,000 rpm for 10 minutes and thereafter filtered;

(2) 100 parts of a 10% aqueous solution of sodium hydroxide was added to the filter cake of (1) and mixed therewith using a TK HOMOMIXER at a revolution of 12,000 rpm for 30 minutes, followed by filtration under reduced pressures;

(3) 100 parts of a 10% aqueous solution of hydrochloric acid was added to the filter cake of (2) and mixed therewith using a TK HOMOMIXER at a revolution of 12,000 rpm for 10 minutes, followed by filtration; and (4) 300 parts of ion-exchange water was added to the filter cake of (3) and mixed therewith using a TK HOMOMIXER at a revolution of 12,000 rpm for 10 minutes, followed by filtration. These operations (1) to (4) were repeated twice, thus obtaining a filter cake 1. The filter cake 1 was dried by a circulating air dryer at 45 degrees C. for 48 hours and then filtered with a mesh having an opening of 75 μm. Thus, mother toner particles were prepared.

Next, 100 parts of the mother toner particles were mixed with 1.0 part of a hydrophobic silica and 0.5 parts of a hydrophobized titanium oxide, both as external additives, using a HENSCHEL MIXER (manufactured by Mitsui Mining and Smelting Co., Ltd.). Thus, a toner 1 was prepared.

Example 2

The procedure in Example 1 was repeated except that, in the process of preparing the oil phase, the amount of the amorphous resin A1 was changed from 750 parts to 520 parts and 230 parts of the wax dispersing agent was further added. Thus, a toner 2 was prepared.

Example 3

The procedure in Example 1 was repeated except that, in the process of preparing the oil phase, the amount of the crystalline polyester resin master batch 1 was changed from 460 parts to 770 parts and the amount of the amorphous resin A1 was changed from 750 parts to 440 parts. Thus, a toner 3 was prepared.

Example 4

The procedure in Example 1 was repeated except that, in the process of preparing the oil phase, the amount of the crystalline polyester resin master batch 1 was changed from 460 parts to 225 parts, the amount of the amorphous resin A1 was changed from 750 parts to 960 parts, and the amount of the wax dispersion liquid was changed from 1,100 parts to 1,080 parts. Thus, a toner 4 was prepared.

Example 5

The procedure in Example 1 was repeated except that, in the process of preparing the oil phase, the crystalline polyester resin master batch 1 was replaced with the crystalline polyester resin master batch 2 and the amorphous resin A1 was replaced with the amorphous resin A2. Thus, a toner 5 was prepared.

Example 6

The procedure in Example 1 was repeated except that the crystalline polyester resin master batch 1 was replaced with the crystalline polyester resin master batch 3 and the crystalline polyester resin C1 was replaced with the crystalline polyester resin C2. Thus, a toner 6 was prepared.

Example 7

The procedure in Example 1 was repeated except that the crystalline polyester resin master batch 1 was replaced with the crystalline polyester resin master batch 4 and the crystalline polyester resin C1 was replaced with the crystalline polyester resin C3. Thus, a toner 7 was prepared.

Example 8

The procedure in Example 1 was repeated except that the crystalline polyester resin master batch 1 was replaced with the crystalline polyester resin master batch 5 and the crystalline polyester resin C1 was replaced with the crystalline polyester resin C4. Thus, a toner 8 was prepared.

Comparative Example 1

The procedure in Example 1 was repeated except that, in the process of preparing the oil phase, the amount of the crystalline polyester resin master batch 1 was changed from 460 parts to 0 part and the amount of the amorphous resin A1 was changed from 750 parts to 1,210 parts. Thus, a toner 9 was prepared.

Comparative Example 2

The procedure in Example 1 was repeated except that, in the process of preparing the oil phase, the crystalline polyester resin master batch 1 was replaced with the crystalline polyester resin master batch 6 and the amorphous resin A1 was replaced with the amorphous resin A3. Thus, a toner 10 was prepared.

Comparative Example 3

The procedure in Example 1 was repeated except that, in the process of preparing the oil phase, the crystalline polyester resin master batch 1 was replaced with the crystalline polyester resin master batch 7. Thus, a toner 11 was prepared.

The contents of the crystalline polyester resins, amorphous resins, wax dispersing agent, and styrene acrylic resins in the toners prepared in Examples are presented in Table 4.

TABLE 4

| | Crystalline Polyester | | | Amount [2)] of | Amount of | Amount [2)] of |
|---|---|---|---|---|---|---|
| | Type | Amount [1)] (% by mass) | Amorphous Resin Type | Polyester (% by mass) | Wax Dispersing Agent | Styrene Acrylic Resin |
| Example 1 | C1 | 6 | A1 | 97 | 5 | 3 |
| Example 2 | C1 | 6 | A1 | 85 | 20 | 15 |
| Example 3 | C1 | 10 | A1 | 97 | 5 | 3 |
| Example 4 | C1 | 3 | A1 | 97 | 5 | 3 |
| Example 5 | C1 | 6 | A2 | 97 | 5 | 3 |
| Example 6 | C2 | 6 | A1 | 97 | 5 | 3 |

TABLE 4-continued

| | Crystalline Polyester | | | Amount [2] of | Amount of | Amount [2] of |
|---|---|---|---|---|---|---|
| | Type | Amount [1] (% by mass) | Amorphous Resin Type | Polyester (% by mass) | Wax Dispersing Agent | Styrene Acrylic Resin |
| Example 7 | C3 | 6 | A1 | 97 | 5 | 3 |
| Example 8 | C4 | 6 | A1 | 97 | 5 | 3 |
| Comparative Example 1 | — | — | A1 | 97 | 5 | 3 |
| Comparative Example 2 | C1 | 6 | A3 | 97 | 5 | 3 |
| Comparative Example 3 | C5 | 6 | A1 | 97 | 5 | 3 |

Note that [1] and [2] in Table 4 refer to:
[1] Proportion in toner (% by mass)
[2] Proportion (% by mass) to binder resins (i.e., crystalline polyester resin, amorphous resin, and styrene acrylic resin)

Measurement of Crystalline Polyester Resin Domain Diameter

The crystalline polyester resin domain diameter, i.e., the number average long diameter of domains of the crystalline polyester resin, of each toner was measured according to the following procedure. The measurement results are presented in Table 5.

(1) Toner was sufficiently dispersed in an epoxy resin which was curable at room temperature and allowed to stand for one day or more. The epoxy resin was then cured to obtain a cured product in which the toner was embedded.

(2) A cross-section of the cured product was made exposed using a microtome equipped with a diamond knife. The cured product with the cross-section exposed was immersed for 3 hours in an organic solvent (hexane) in which only the release agent was soluble, so that only domains of the release agent got dissolved.

(3) The cured product was thereafter dried for one day or more, a thin film section was then cut out under the following cutting conditions, and the obtained thin film section was stained with ruthenium tetroxide.

[Cutting Conditions]

Cutting thickness: 75 nm

Cutting speed: 0.05 to 0.2 mm/sec

Knife: Diamond knife (Ultra Sonic 35°)

Next, the sample was observed according to the following observation conditions.

[Observation Conditions]

Instrument: Transmission electron microscope JEM-2100F available from JEOL Ltd.

Magnification: 30,000 times

Acceleration voltage: 200 kV

Morphological observation: Bright-field method

Settings: Spot size 3, CLAP 1, OLAP 3, Alpha 3

The obtained image was subjected to a binarization process (threshold 80/255 steps) using an image analysis software program "Image-J". A portion surrounded by a black boundary line through the binarization process was identified as a domain derived from the crystalline polyester.

In the Examples, the long diameter of a domain of the crystalline polyester was the longest diameter of the domain derived from the crystalline polyester. In a case in which the domain had an irregular shape, the long diameter was measured by a method which can measure the longest diameter.

Based on the TEM image, the number average long diameter of domains of the crystalline polyester was measured. Specifically, cross-sections of 50 toner particles in which the long diameter of the toner particle was in the range of ±20% of the number average particle diameter of the toner were observed. The number average particle diameter of the toner was measured by a particle size distribution measuring instrument (MULTISIZER III available from Beckman Coulter, Inc.). The long diameter was measured for all domains of the crystalline polyester present in each of the cross-sections of 50 toner particles, and the arithmetic mean value thereof was calculated. The obtained arithmetic mean value was taken as the number average long diameter of domains of the crystalline polyester.

Measurement of Viscoelasticity G'(50) and G'(90) of Toner

The viscoelasticity (storage elastic modulus) of the obtained toners was measured as follows. The measurement results are presented in Table 5.

The storage elastic modulus was measured with a rheometer (ARES available from TA Instruments). The obtained toner was molded into a pellet having a diameter of 8 mm and a thickness of 1 to 2 mm. The pellet was set between parallel plates having a diameter of 8 mm and stabilized at 40 degrees C. The temperature was then raised to 200 degrees C. at a temperature rising rate of 2.0 degrees C./min under a frequency of 1 Hz (6.28 rad/s) and a strain amount of 0.1% (strain amount control mode) to measure the storage elastic modulus at 50 degrees C. and at 90 degrees C.

Measurement by DSC

Using a differential scanning calorimeter (DSC-60 available from Shimadzu Corporation), 5 mg of a sample weighed in an aluminum pan was cooled to 0 degrees C. at a temperature falling rate of 10 degrees C./min and then heated at a temperature rising rate of 10 degrees C./min, to measure the amount of heat absorption from an endothermic peak within a range of from 0 to 150 degrees C. The measurement results are presented in Table 5.

TABLE 5

| | Crystalline Polyester Domain | Toner Storage Elastic Modulus (G') | | | |
|---|---|---|---|---|---|
| | Diameter (nm) | G'(50) (Pa) | G'(90) (Pa) | G'(50)/G'(90) | DSC (J/g) |
| Example 1 | 0 | $2.8 \times 10^7$ | $4.0 \times 10^4$ | $7.0 \times 10^2$ | 6.7 |
| Example 2 | 48 | $3.0 \times 10^7$ | $5.0 \times 10^4$ | $6.0 \times 10^2$ | 6.7 |
| Example 3 | 30 | $2.6 \times 10^7$ | $3.7 \times 10^4$ | $7.0 \times 10^2$ | 11.2 |
| Example 4 | 0 | $2.9 \times 10^7$ | $4.8 \times 10^4$ | $6.0 \times 10^2$ | 3.7 |
| Example 5 | 30 | $2.7 \times 10^7$ | $3.8 \times 10^4$ | $7.0 \times 10^2$ | 5.0 |
| Example 6 | 20 | $3.1 \times 10^7$ | $4.3 \times 10^4$ | $7.2 \times 10^2$ | 7.3 |
| Example 7 | 0 | $2.6 \times 10^7$ | $4.0 \times 10^4$ | $6.4 \times 10^2$ | 5.9 |
| Example 8 | 0 | $2.4 \times 10^7$ | $3.9 \times 10^4$ | $6.1 \times 10^2$ | 4.3 |
| Comparative Example 1 | 0 | $3.0 \times 10^7$ | $1.0 \times 10^4$ | $3.0 \times 10^2$ | 0.0 |

TABLE 5-continued

| | Crystalline Polyester Domain | Toner Storage Elastic Modulus (G') | | | |
|---|---|---|---|---|---|
| | Diameter (nm) | G'(50) (Pa) | G'(90) (Pa) | G'(50)/G'(90) | DSC (J/g) |
| Comparative Example 2 | 60 | $2.8 \times 10^7$ | $4.0 \times 10^4$ | $7.0 \times 10^2$ | 6.7 |
| Comparative Example 3 | 0 | $2.2 \times 10^7$ | $4.0 \times 10^4$ | $5.5 \times 10^2$ | 2.2 |

Low-temperature fixability and heat-resistant storage stability of the obtained toners were evaluated as follows. The evaluation results are presented in Table 6.

Low-temperature Fixability

A copy test was performed by a copier MF2200 (manufactured by Ricoh Co., Ltd.) employing a TEFLON (registered trademark) roller as the fixing roller, the fixing unit of which had been modified, using a paper TYPE 6200 (manufactured by Ricoh Co., Ltd.).

In the test, the cold offset temperature (lower-limit fixable temperature) was determined by varying the fixing temperature to evaluate low-temperature fixability based on the below-described evaluation criteria.

The lower-limit fixable temperature was evaluated while setting the sheet feed linear velocity to 120 to 150 mm/sec, the surface pressure to 1.2 kgf/cm$^2$, and the nip width to 3 mm.

The upper-limit fixable temperature was evaluated while setting the sheet feed linear velocity to 50 mm/sec, the surface pressure to 2.0 kgf/cm$^2$, and the nip width to 4.5 mm.

Evaluation Criteria for Low-temperature Fixability (Lower Limit of Fixing)

A: Cold offset temperature is less than 115 degrees C.

B: Cold offset temperature is 115 degrees C. or higher and lower than 125 degrees C.

C: Cold offset temperature is 125 degrees C. or higher and lower than 135 degrees C.

D: Cold offset temperature is 135 degrees C. or higher.

Heat-resistant Storage Stability

Each toner was stored at 50 degrees C. for 8 hours and thereafter sieved with a 42 mesh for 2 minutes. The residual rate of toner particles remaining on the mesh was measured. The smaller the residual rate, the better the heat-resistant storage stability.

Heat-resistant storage stability was evaluated based on the following criteria.

Evaluation Criteria

A: Residual rate is less than 5%.

B: Residual rate is 5% or higher and lower than 15%.

C: Residual rate is 15% or higher and lower than 25%.

D: Residual rate is 25% or higher.

TABLE 6

| | Fixability | Heat-resistant Storage Stability |
|---|---|---|
| Example 1 | A | A |
| Example 2 | B | C |
| Example 3 | A | B |
| Example 4 | B | A |
| Example 5 | B | B |
| Example 6 | B | B |
| Example 7 | A | B |
| Example 8 | A | C |
| Comparative Example 1 | D | A |
| Comparative Example 2 | B | D |
| Comparative Example 3 | A | D |

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A toner comprising:

a binder resin comprising a polyester resin comprising a crystalline polyester resin;

a colorant; and a release agent, wherein the crystalline polyester resin forms domains having a number average long diameter of from 0 to 50 nm in a cross-section of the toner, wherein the toner satisfies the following relation:

$$9.0\times10^2 \geq G'(50)/G'(90) \geq 6.0\times10^2$$

where G'(50) and G'(90) represent storage elastic modulus of the toner at 50 degrees C. and 90 degrees C., respectively, wherein the binder resin further comprises a styrene acrylic resin, and a proportion of the styrene acrylic resin in the binder resin is less than 10% by mass.

2. The toner according to claim 1, wherein a proportion of the polyester resin in the binder resin is 90% by mass or more.

3. The toner according to claim 2, wherein the number average long diameter of the domains of the crystalline polyester resin is from 0 to 10 nm.

4. The toner according to claim 1, wherein the binder resin further comprises a styrene acrylic resin, and a proportion of the styrene acrylic resin in the binder resin is less than 5% by mass.

5. The toner according to claim 1, wherein the number average long diameter of the domains of the crystalline polyester resin is from 0 to 10 nm.

6. A toner accommodating unit comprising:

a container; and the toner according to claim 1 contained in the container.

7. An image forming apparatus comprising:

an electrostatic latent image bearer;

an electrostatic latent image forming device configured to form an electrostatic latent image on the electrostatic latent image bearer; and a developing device containing the toner according to claim 1, configured to develop the electrostatic latent image formed on the electrostatic latent image bearer with the toner to form a toner image.

8. The image forming apparatus according to claim 7, further comprising:

a transfer device configured to transfer the toner image formed on the electrostatic latent image onto a surface of a recording medium; and a fixing device configured to fix the toner image on the surface of the recording medium.

9. A toner comprising:

a binder resin comprising a polyester resin comprising a crystalline polyester resin;

a colorant; and a release agent, wherein the crystalline polyester resin forms domains having a number average long diameter of from 0 to 50 nm in a cross-section of the toner, wherein the toner satisfies the following relation:

$$9.0\times10^2 \geq G'(50)/G'(90) \geq 6.0\times10^2$$

where G'(50) and G'(90) represent storage elastic modulus of the toner at 50 degrees C. and 90 degrees C., respectively, wherein the toner exhibits an endothermic peak indicating an amount of heat absorption of 3 J/g or more in a first temperature rising of differential scanning calorimetry, the endothermic peak derived from the crystalline polyester resin.

10. The toner according to claim 9, wherein a proportion of the polyester resin in the binder resin is 90% by mass or more.

11. The toner according to claim 10, wherein the number average long diameter of the domains of the crystalline polyester resin is from 0 to 10 nm.

12. The toner according to claim 9, wherein the binder resin further comprises a styrene acrylic resin, and a proportion of the styrene acrylic resin in the binder resin is less than 10% by mass.

13. The toner according to claim 9, wherein the binder resin further comprises a styrene acrylic resin, and a proportion of the styrene acrylic resin in the binder resin is less than 5% by mass.

14. The toner according to claim 9, wherein the number average long diameter of the domains of the crystalline polyester resin is from 0 to 10 nm.

15. A toner accommodating unit comprising:

a container; and the toner according to claim 9 contained in the container.

16. An image forming apparatus comprising:

an electrostatic latent image bearer;

an electrostatic latent image forming device configured to form an electrostatic latent image on the electrostatic latent image bearer; and a developing device containing the toner according to claim 9, configured to develop the electrostatic latent image formed on the electrostatic latent image bearer with the toner to form a toner image.

17. The image forming apparatus according to claim 16, further comprising:

a transfer device configured to transfer the toner image formed on the electrostatic latent image onto a surface of a recording medium; and a fixing device configured to fix the toner image on the surface of the recording medium.

* * * * *